US005710692A

United States Patent [19]

Muck et al.

[11] Patent Number: 5,710,692

[45] Date of Patent: Jan. 20, 1998

[54] DURABLE COMPACT STATIC ELIMINATION DEVICE FOR USE IN A DOCUMENT PRODUCTION MACHINE

[75] Inventors: Dennis N. Muck, Rochester; Stefan A. Jasinski; Frank A. Grossi, both of Webster; Frank R. Papalia, Fairport, all of N.Y.

[73] Assignee: Xerox Corporation, Stamford, Conn.

[21] Appl. No.: 673,519

[22] Filed: Jul. 1, 1996

[51] Int. Cl.[6] ..... H05F 1/00

[52] U.S. Cl. ..... 361/212; 361/220

[58] Field of Search ..... 361/214, 220, 361/221, 212

[56] References Cited

U.S. PATENT DOCUMENTS 5,501,899 3/1996 Larkin ..... 361/212

*Primary Examiner*—Fritz Fleming

*Attorney, Agent, or Firm*—Tallam I. Nguti

[57] ABSTRACT

In a reproduction machine, a static elimination device for removing static charge from a sheet of material being conveyed along a sheet path through a sheet handling machine. The static elimination device includes a thin flexible support member having a first length suitable for spanning across the sheet path, and a first width defining an area with the first length for supporting a static charge removing member. The static charge removing member has a second length substantially equal to the first length of the support member, and a second width greater than the first width of the support member, and is mounted to the support member. In particular, the static removing member comprises a conductive fabric for mounting in a static removing relationship with a sheet being conveyed along the sheet path of the sheet handling machine. The fabric consists of innumerable thin fibers forming fabric segments. Each thin fiber has a conductive plating, and each segment of the fabric includes a non-woven innumerable number of the thin fibers forming a compressed, and bonded pile having highly random orientations of individual fibers.

11 Claims, 8 Drawing Sheets

DURABLE COMPACT STATIC ELIMINATION DEVICE FOR USE IN A DOCUMENT PRODUCTION MACHINE

BACKGROUND OF THE INVENTION

This invention relates to static elimination devices, and more particularly to a sheet handling machine, such as a copy production machine, including a durable compact, and highly effective static elimination device for eliminating static and static related problems from sheets being handled by the machine.

Sheet handling machines are well known, and principally include document production machines such as printers of all kinds, and electrostatographic reproduction machines. Generally, the process of electrostatographic reproduction, for example, includes uniformly charging an image frame of a moving photoconductive member, or photoreceptor, with a first charging device to a substantially uniform potential, and imagewise discharging it or imagewise exposing it to light reflected from an original image being reproduced. The result is an electrostatically formed latent image on the image frame of the photoconductive member. For multiple original images, several such frames are similarly imaged.

The latent image so formed on each frame is developed by bringing a charged developer material into contact therewith. Two-component and single-component developer materials are commonly used. A typical two-component developer material comprises magnetic carrier particles, also known as "carrier beads," having fusable charged toner particles adhering triboelectrically thereto. A single component developer material typically comprises charged toner particles only.

In either case, the fusable charged toner particles when brought into contact with each latent image, are attracted to such image, thus forming a toner image on the photoconductive member. The toner image is subsequently transferred with the help of a second charging device to an image receiver copy sheet which is then passed along a sheet path through a fuser apparatus where the toner image is heated and permanently fused to the copy sheet, forming a hard copy of each of the original images.

Typically, the sheet path in such a sheet handling machine is defined by conveyors, nip forming rollers, and sheet charging devices. The nip forming rollers, for example, include a pair of rollers comprising the fuser apparatus which is located at a point just before each fused hard copy image is fed out to an output tray. As is well known, the sheet path as above ordinarily results in undesirably high levels of static charges, or of residual electrostatic charge, on each sheet, particularly as the sheet is being fed out of the fuser apparatus. An illustration of an undesirably high level of static charge on such a sheet is shown, for example, in FIG. 9 of the drawings, and results of an attempted static elimination of charge on such a sheet using a conventional carbon fibers brush, are illustrated in FIG. 10 of the drawings.

Ordinarily, significant levels of unremoved static charge on sheets already fed into an output tray, as well as on an incoming sheet being fed out of a fuser apparatus onto the other sheets in the tray, will cause the latter sheet to float or even scatter uncontrollably relative to the output tray. Neatly, collated sheet stacks ready for stapling are therefore not possible to achieve. Additionally, once the incoming sheet contacts the other sheets already in the output tray, usually in an undesirable alignment, it can become difficult to separate the sheets, due to static charge effects.

Conventionally, carbon fiber brushes on a rigid aluminum frame, for example, have been used for contacting each such sheet in order to reduce the level of static charge on the sheet. Such a brush is usually bulky and costly. Because it is on a rigid frame, it is difficult to install in tight sheet path areas, and furthermore, its effectiveness depends on the number of fiber tip ends that successfully contact the sheet being discharged. It has been noticed too that frequent passing contact between carbon fibers and other machine parts, such as with the interface of an output bin sorter, usually tend to damage the carbon fibers, thus reducing the life of such a brush.

There has therefore been a need for a compact, flexible, and durable static elimination device that can be installed in tight machine areas, and that is highly effective in eliminating static charge.

SUMMARY OF THE INVENTION

In accordance with the present invention, there is provided a static elimination device for removing static charge from a sheet of material being conveyed along a sheet path through a sheet handling machine. The static elimination device includes a thin flexible support member having a first length suitable for spanning across the sheet path, and a first width defining an area with the first length for supporting a static charge removing member. The static charge removing member has a second length substantially equal to the first length of the support member, and a second width greater than the first width of the support member, and is mounted to the support member. In particular, the static removing member comprises a conductive fabric for mounting in a static removing relationship with a sheet being conveyed along the sheet path of the sheet handling machine. The conductive fabric consists of innumerable thin fibers. Each thin fiber has a conductive plating, and each segment of the fabric includes a non-woven innumerable number of the thin fibers forming a compressed, and bonded, pile having highly random orientations of individual fibers.

Other features of the present invention will become apparent from the following drawings and description.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 12:
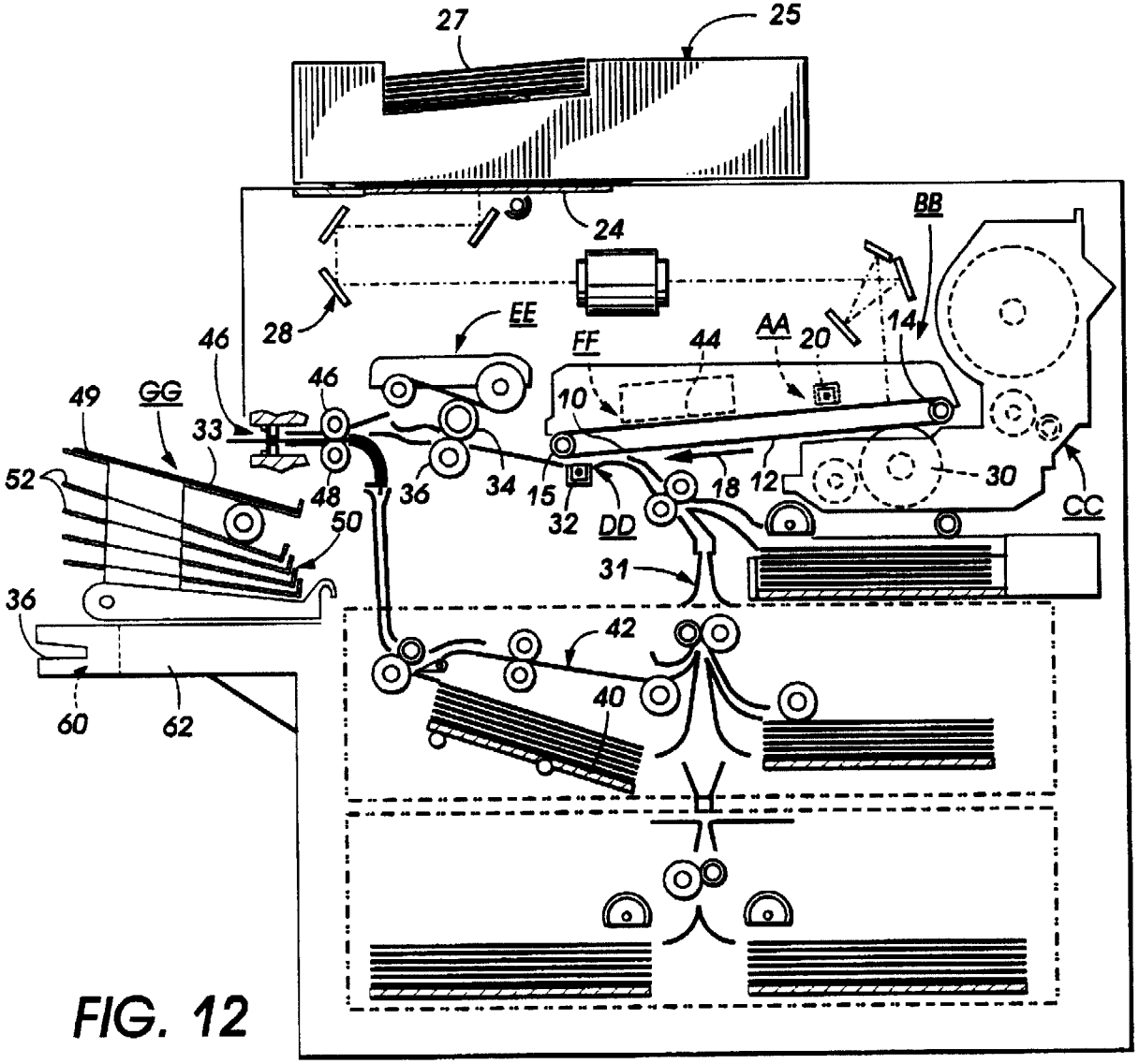
FIG. 12 is a vertical schematic of an exemplary electrostatographic reproduction machine including the static elimination device in accordance with the present invention.

Referring first to FIG. 12, an exemplary electrostatographic reproduction machine 8 according to the present invention is illustrated. As shown, the machine 8 has conventional imaging processing stations associated therewith, including a charging station AA, an imaging/exposing station BB, a development station CC, a transfer station DD, a fusing station EE, a finishing station GG, and a cleaning station FF.

As shown, the machine 8 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 8 can be briefly described as follows. Initially, the photoconductive belt 10 is charged at the charging station AA by a corona generating device 20. The charged portion of the belt is then transported by action of the drive roller 14 to the imaging/exposing station BB where a latent image is formed on the belt 10 corresponding to the image on a document positioned on a platen 24 via the light lens imaging system 28 of the imaging/exposing station BB. It will also be understood that the light lens imaging system can easily be changed to an input/output scanning terminal or an output scanning terminal driven by a data input signal to likewise image the belt 10. As is also well known, the document on the platen 24 can be placed there manually, or it can be fed there automatically by an automatic document handler device 25 that includes a multiple document sheet holding tray 27.

The portion of the belt 10 bearing the latent image is then transported to the development station CC where the latent image is developed by electrically charged toner material from a magnetic developer roller 30 of the developer station CC. The developed image on the belt is then transported to the transfer station DD where the toner image is transferred to a copy sheet 33 fed by a copy sheet handling system 31. In this case, a corona generating device 32 is provided for charging the copy sheet 33 so as to attract the charged toner image from the photoconductive belt 10 to the copy sheet.

The copy sheet 33 with the transferred image thereon is then directed to the fuser station EE. The fuser apparatus at station EE includes a heated fuser roll 34 and backup pressure roll 36. The heated fuser roll 34 and pressure roll 36 rotatably cooperate to fuse and fix the toner image onto the copy sheet. The copy sheet 33 then, as is well known, may be selectively transported to the finishing area GG, or to a duplex tray 40 along a selectable duplex path 42 for duplexing.

The portion of the belt 10 from which the developed image was transferred is then advanced to the cleaning station FF where residual toner and charge on the belt are removed by a cleaning device such as a blade 44, and a discharge lamp (not shown) in order to prepare the portion for a subsequent imaging cycle.

When not doing duplex imaging, or at the end of such duplex imaging, the copy sheets upon finally leaving the fusing rolls 34, 36, are passed to finishing area input rolls 46 and 48. From the input rolls 46, 48, the copy sheets are fed, for example, individually through the static elimination device 70 of the present invention (to be described in detail below), and then to an output tray 49 or to a bin sorter apparatus 50 where the sheets can be arranged in a collated unstapled set within the tray 49 or within each bin 52 of the bin sorter apparatus 50.

A machine user or operator making such a set of copy sheets 33 on the reproduction machine 8 can thus manually remove each such set at a time, and insert a corner or edge of the set into a convenience stapler assembly 60, for example, for convenient stapling. As shown, the convenient stapler assembly 60 is built into a portion 62 of the frame of the machine 8, and at a location conveniently close to the bin sorter apparatus or output tray.

Figure 9:
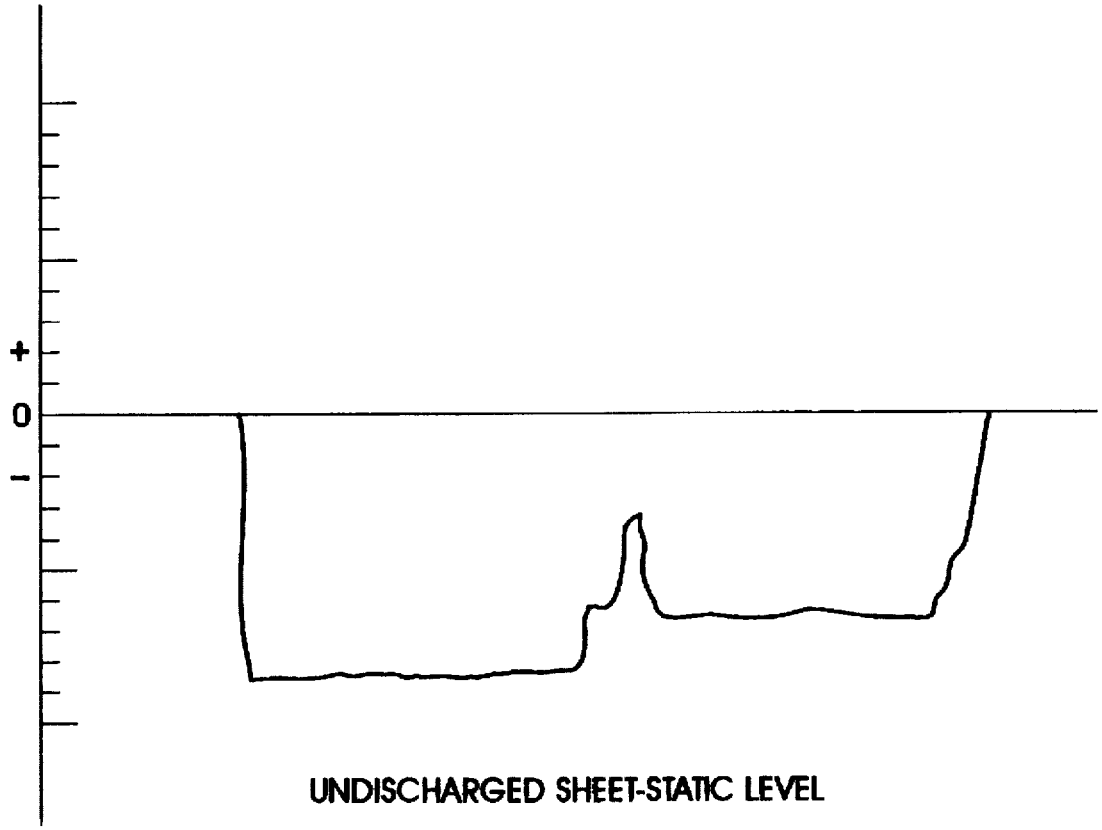
FIG. 9 is a sample plot of static charge levels on an undischarged sheet from a fuser apparatus without contact with any static elimination device.

Ordinarily, hot fused and dry sheets 33, will each pick up additional, undesirable static charge as each is advanced through the feed out rolls 46, 48 (FIG. 9). If such static charge is not discharged or eliminated, the sheet will either float out of, or scatter uncontrollably in, the receiving tray 49. In other situations the sheets if carrying charges, can actually be difficult to separate once stacked together. Accordingly, in order to prevent such problems, each sheet is therefore passed through the static elimination device 70 of the present invention.

Referring now to FIGS. 1 to 6, different views of several embodiments 70A, 70B, 70C of the static elimination device 70 of the present invention are illustrated, and are generally suitable for removing static charge from a sheet of material 33 being conveyed along a sheet path through a sheet handling machine. As shown, each embodiment 70A, 70B, 70C of the static elimination device 70 includes a thin flexible support member 72, that is preferably made of a polyester film material, such as MYLAR (trademark of the Du Pont (UK) Ltd). The flexible support member 72 has a first length L1 suitable for spanning across the sheet path of the machine, and a first width W1 defining an area with the first length L1 for supporting a static charge removing member.

Each embodiment 70A, 70B, 70C of the static elimination device 70 also includes a static charge removing member 80 that is mounted to the support member 72 so as to be additionally flexible relative to the support member 72. The static charge removing member 80 has a second length L2 that is substantially equal to the first length L1 of the support member 72, and a second width W2 that is greater than the first width W1 of the support member so as to enable the additional flexibility of the member 80.

Importantly, in accordance with the present invention, the static charge removing member 80 comprises a conductive fabric 82 for mounting in a static removing relationship with a sheet being conveyed along the sheet path of the sheet handling machine. The fabric 82 consists of innumerable thin fibers 85 made preferably of a high strength synthetic material such as nylon (a polyamide material prepared by condensation from adipic acid, related acids, hexamethylene, and related diamines). Each of the thin fibers 85 has a conductive plating preferably of silver, and each segment that is, any portion or slice of the fabric 82, as pointed out above, includes a non-woven innumerable number of the thin fibers forming a compressed, pinned and bonded pile having highly random orientations of individual fibers, for mounting in a static removing relationship to the sheet path. The compressed pile of fibers is pin bonded, for example, using a suitable bonding material 83 in an orthogonally alternating pattern as shown for example in FIGS. 7 and 8 to make fabric 82. The bonding material is selected so that it remains flexible even after curing. As such, each segment of the fabric is flexible, thereby enabling mounting of the device 70 (70A, 70B, 70C ) effectively to even irregular surfaces. The fabric has a maximum surface resistivity of about 0.5 ohm-cm, a thickness of less than 0.01", and a tensile strength of greater than 180 lbs/ft.2 min. so as to enable it to durably with stand rubbing contact with sheet path defining components within the machine. An example of such a fabric 82 is sold under the trademark PBN II™ (trademark of Cerex Advanced Fabrics, L. P. (Delaware)).

Figure 8:
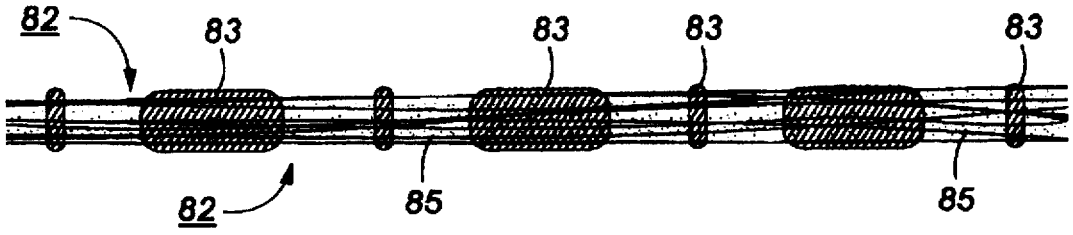
FIG. 8 is an illustration of a section of the fabric of FIG. 7 showing innumerable, random orientation silver plated fibers, and bonding material.

As further illustrated, each embodiment 70A, 70B, 70C of the static elimination device 70 also importantly includes a serrated discharging edge 84 of the fabric 80 for positioning immediately adjacent the sheet path so as to contact a sheet being discharged. As illustrated in FIG. 8, a cross-sectional surface area of the fabric 82 that is suitable for forming the discharging edge 84 of the device 70, advantageously has random orientations of individual fibers, and a random mix of surface areas of edge exposed fibers. Such a random mix may include cut fiber tip ends, as well as cut and uncut longitudinal sections of fibers having various lengths, for maximizing a total available surface area for discharging static charge from a sheet surface contacted by an edge 84.

Each embodiment 70A, 70B, 70C of the static elimination device 70 also includes an attaching device 88 consisting for example of a double-sided adhesive tape, for attaching a portion of the conductive fabric 82 to the thin flexible support member 72. The static elimination device 70A, 70B, or 70C is mountable to a conductive, grounding member 90 within the machine 8, so as to position the discharging edge 84 of each static removing member along a sheet path.

Figure 1:
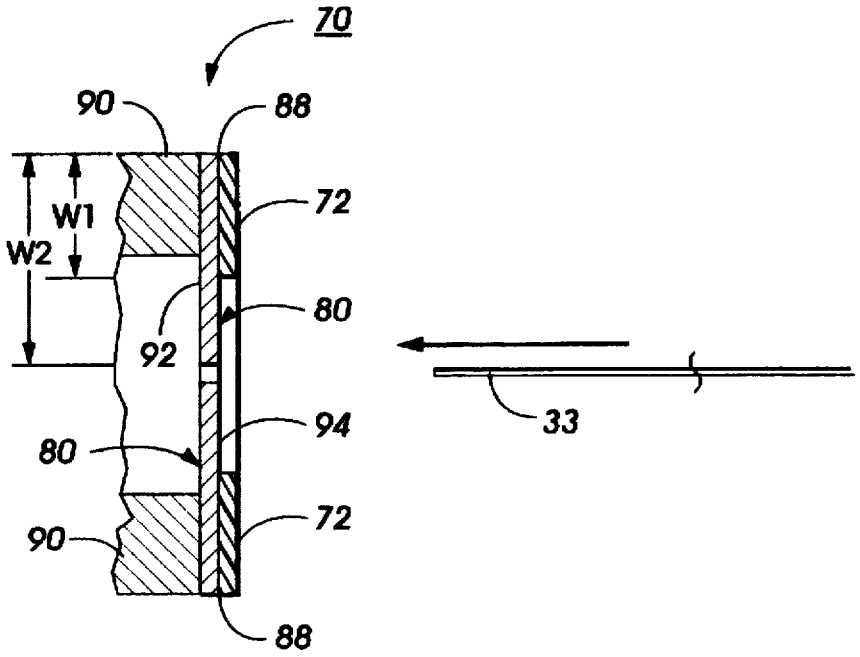
FIG. 1 is a vertical section of a first embodiment of the static elimination device of the present invention.
Figure 2:
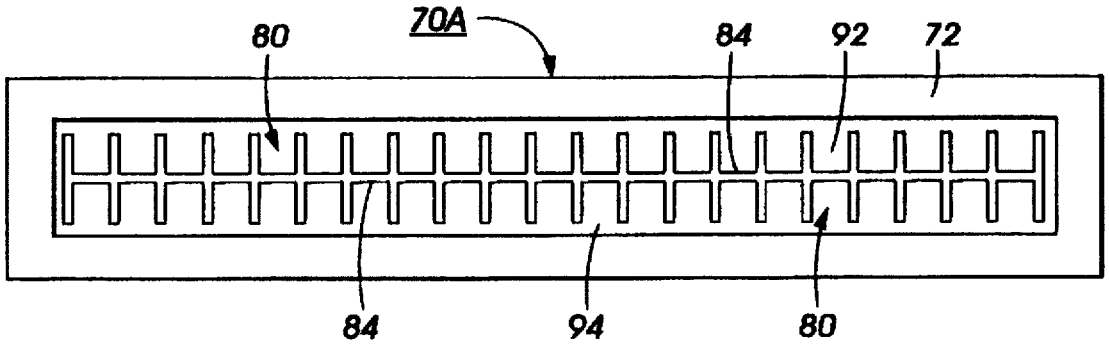
FIG. 2 is a front view illustration of the static elimination device of FIG. 1.

A first embodiment 70A of the static elimination device 70 is illustrated in FIGS. 1 and 2, and includes the thin flexible support member 72 suitable for supporting a first 92 and a second 94 static charge removing members. The first 92 and second 94 static charge removing members, as shown, are mounted to the support member 72, and each comprises the conductive fabric 82. The embodiment 70A is mounted to the conductive member 90, such that the distal serrated edge 84 of first static removing member 92 contacts a first side of the sheet 33, and that of the second member 94, simultaneously contacts a second and opposite side of the sheet.

Figure 3:
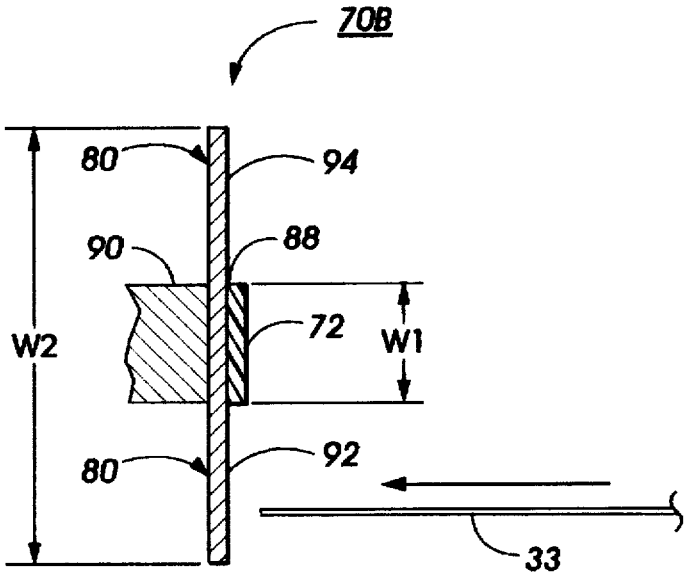
FIG. 3 is a second embodiment of the static elimination device of the present invention.
Figure 4:
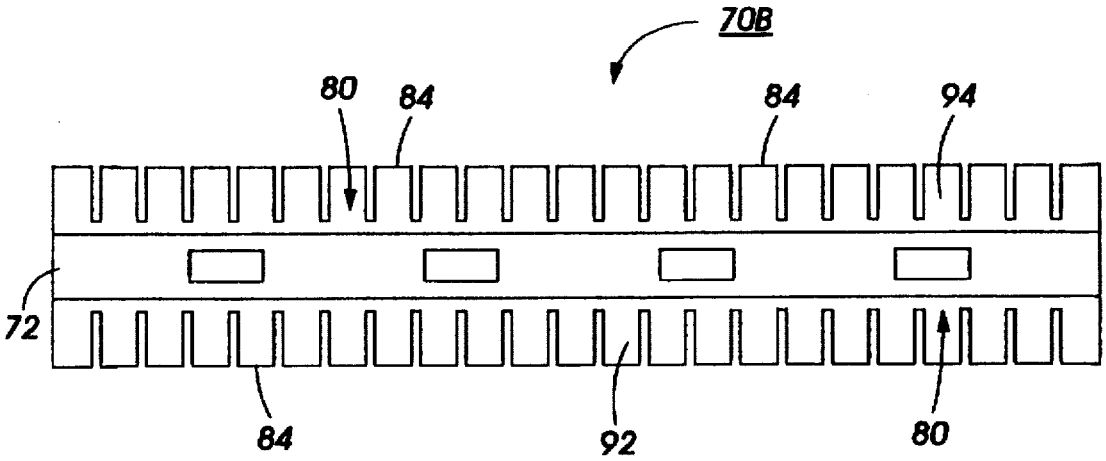
FIG. 4 is a front view illustration of the static elimination device of FIG. 3.

In the second embodiment 70B as shown in FIGS. 3 and 4, the first 92 and second 94 static removing members thereof are mounted such that only one of the distal serrated static discharging edges 84 of the first 92, OR of the second 94, static removing members can face the sheet path at a time. As such, this embodiment merely provides for an opportunity to reverse the mounting orientation so as to switch from 92 being in contact with a sheet, to 94 being in such contact, particularly after 92 has worn out.

Figure 5:
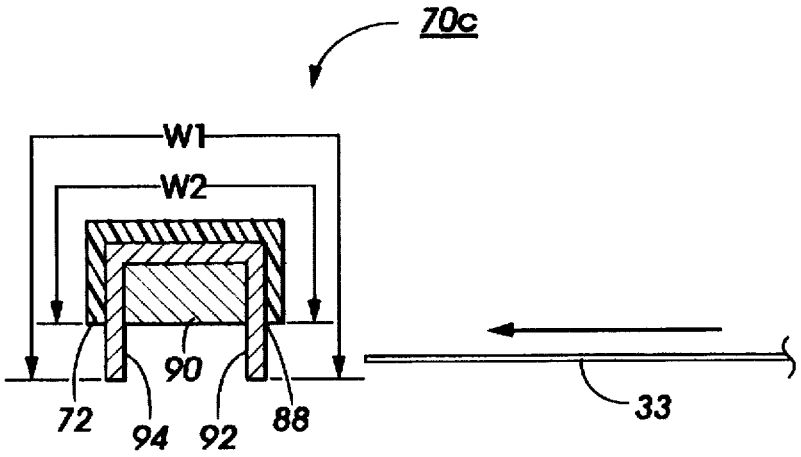
FIG. 5 is a vertical section of a third embodiment of the static elimination device of the present invention.
Figure 6:
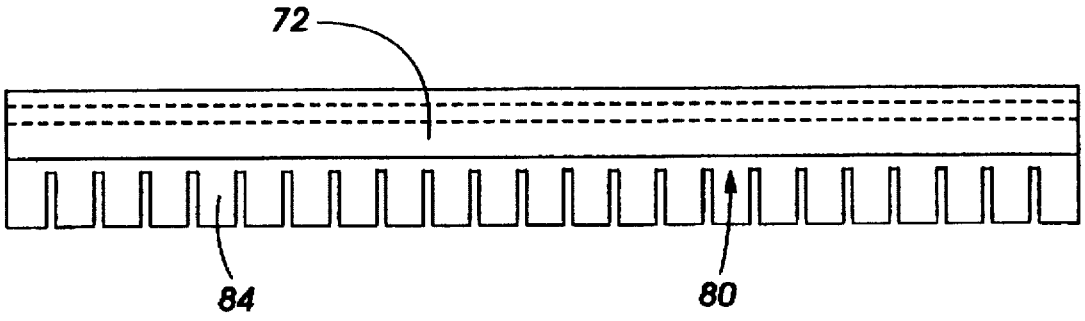
FIG. 6 is a front view illustration of the static elimination device of FIG. 5, as well as that of a fourth embodiment which is only half either of the second embodiment of FIG. 3 or of the third embodiment of FIG. 5.

In the third embodiment 70C as shown in FIGS. 5 and 6, the first 92 and second 94 static removing members thereof are mounted such that both of the distal serrated static discharging edges 84 of the first 92, and of the second 94, static removing members are facing the sheet path at the same time, but are arranged so as to, one after the other, contact the same side of a sheet being discharged. In this embodiment, the first width W1 of the flexible support member 72 is U-shaped, thus having first and second U-arms, and the first and the second static removing members 92, 94 are mounted to the first and second U-arms respectively so as to provide sequential double static removing action by the first 92, and the second 94, static removing members on a same side of a sheet being fed passed the static elimination device.

Figure 7:
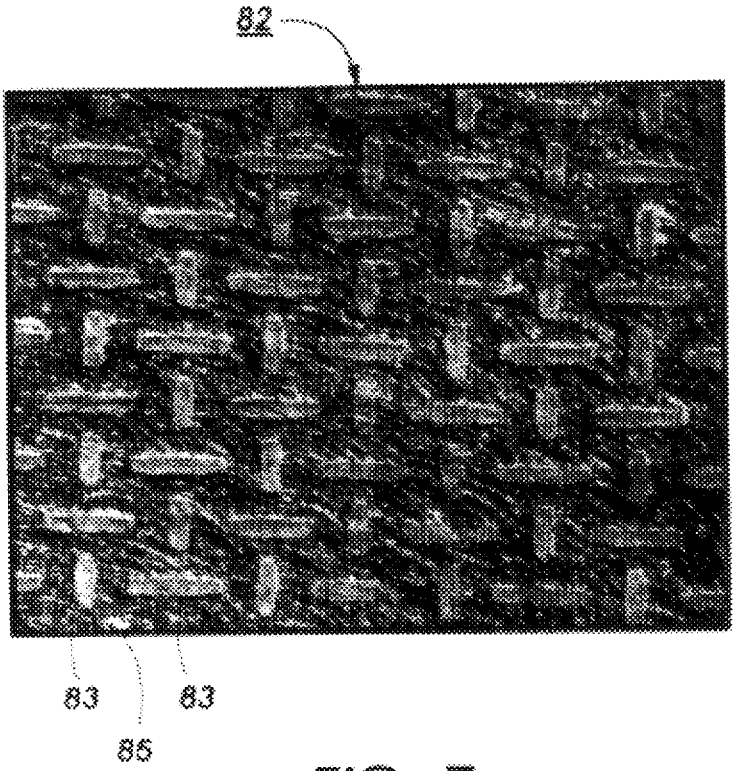
FIG. 7 is a top illustration of a sheet of the fabric of the present invention.

FIG. 7 is a top illustration of a segment of a sheet of the fabric 82 of the present invention showing the bonding material 83, the bonding pattern, and the compressed pile of fibers 85 in the pin bonded state. FIG. 8 is an illustration of a section of the fabric 82 of FIG. 7 showing innumerable, random orientation silver plated fibers 85 compressed and bonded, as well as a bonding pattern, and bonding material 83.

Figure 10:
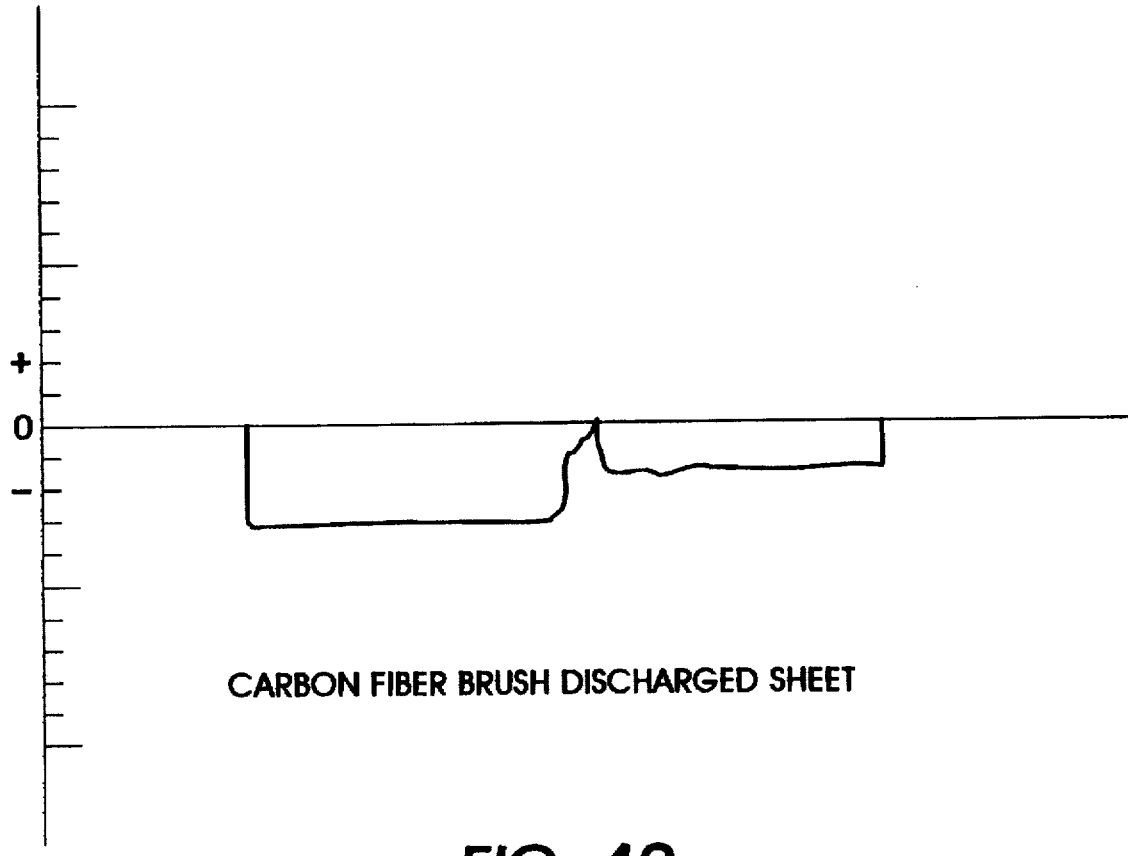
FIG. 10 is a sample plot of static charge levels remaining on a sheet as of FIG. 9 after discharging contact with a prior art carbon fiber brush device.

In FIG. 9, a sample plot of static charge levels on an undischarged sheet fed without static discharge from a fuser apparatus, is illustrated, and in FIG. 10, that of a sample plot of static charge levels remaining on a sheet (as the sheet of FIG. 9) after discharging contact with a prior art carbon fiber brush device. Note that there has been a reduction of just less than 70% from the undischarged levels of FIG. 9, how ever the more than 30% remaining level of charge still presents the same problems associated with undischarged sheets, though to a lesser degree.

Figure 11:
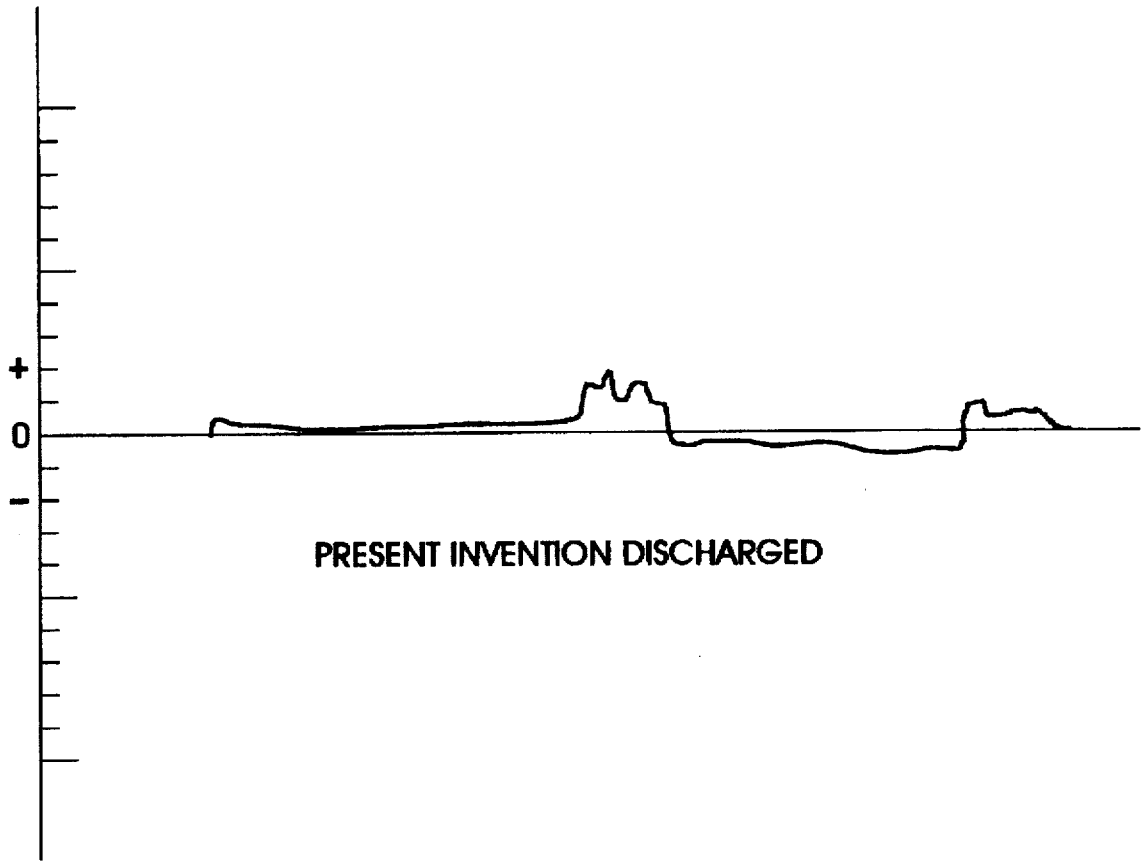
FIG. 11 shows results as in FIG. 10 using the fabric static elimination device of the present invention.

The results from using the static elimination device 70 (70A, 70B, 70C) of the present invention are illustrated in FIG. 11. The drastic reduction, and even neutralization of charge on the sheet is evident. The average level of charge remaining is about 0%.

To recapitulate, the device 70 (70A, 70B, 70C) is mounted within the machine such that the second length L2 of the conductive static removing fabric 82 thereof is longitudinally placed across the sheet path, and hence across the copy sheet, and such that it touches the advancing copy sheet. In so doing, it advantageously discharges charge from the sheet by means of virtually an infinite number of the very thin silver plated nylon fibers 85 contacting the sheet. The belief is that the thinner the discharging fibers, and the higher the discharging area and density of fibers in contact with the copy sheet, the more efficient and complete will be the electrostatic discharging by the device 70. In these respects, the conductive fabric of the device of the present invention has been found to be superior to any carbon or stainless steel fiber static dissipators, (FIGS. 9 to 11 ).

It is, therefore, apparent that there has been provided in accordance with the present invention, a compact, durable and highly effective static elimination device that fully satisfies the aims and advantages hereinbefore set forth.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A static elimination device for removing static charge from a sheet of material being conveyed along a sheet path through a sheet handling machine, the static elimination device comprising:

(a) a thin flexible support member having a first length for spanning across the sheet path, and a first width defining an area with said first length for supporting a static charge removing member; and (b) a static charge removing member mounted to said support member and having a second length substantially equal to said first length of said support member, and a second width greater than said first width, said static charge removing member comprising a conductive fabric including thin fibers forming a sheet of said conductive fabric, each fiber of said thin fibers having a conductive plating, said sheet of said conductive fabric comprising a non-woven innumerable number of said thin fibers piled, compressed and bonded, and said sheet of said conductive fabric having a cross-section including highly random orientations of cut tip ends and uncut longitudinal sections of individual fibers of said thin fibers for maximizing a total available surface area of said thin fibers forming a static eliminating edge of said static charge removing member.

2. The static elimination device of claim 1, wherein said thin flexible support member is a polyester film material.

3. The static elimination device of claim 1, including attaching means for attaching a portion of said conductive fabric to said thin flexible support member.

4. The static elimination device of claim 3, wherein said attaching means consists of a double-sided adhesive tape.

5. The static elimination device of claim 1, wherein said fabric has a tensile strength of greater than 180 lbs/ft.min.

6. The static elimination device of claim 1, wherein said thin fibers are made of nylon material.

7. The static elimination device of claim 1, wherein said conductive plating of each of said thin fibers comprises a silver plating.

8. The static elimination device of claim 1, wherein said fabric has a thickness of about 0.01 inch.

9. The static elimination device of claim 1, wherein a discharging edge of said fabric for positioning immediately adjacent the sheet path is serrated.

10. A static elimination device for removing static charge from a sheet of material being conveyed along a sheet path through a sheet handling machine, the static elimination device comprising:

(a) a thin flexible support member having a first length suitable for spanning across the sheet path, and a first width defining an area with said first length for supporting a first and a second static charge removing members;

(b) a first and a second static charge removing members mounted to said support member, each said first and said second static charge removing members having a second length substantially equal to said first length of said support member, and a second width greater than said first width of said support member, and each said first and said second static removing member comprising a conductive fabric including thin fibers forming a sheet of said conductive fabric, each fiber of said thin fibers having a conductive plating, said sheet of said conductive fabric comprising a non-woven innumerable number of said thin fibers piled, compressed and bonded, and said sheet of said conductive fabric having a cross-section including highly random orientations of cut tip ends and uncut longitudinal sections of individual fibers of said thin fibers for maximizing a total available surface area of said thin fibers forming a static eliminating edge of said static charge removing member; and (c) attaching means for attaching said first and said second charge removing members to said thin flexible support member, attaching means consisting of a double-sided adhesive tape.

11. The static elimination device of claim 10, wherein said first and said second static removing members each have a distal serrated discharging for removing static charge, said first and said second static removing members being mounted oppositely with said distal serrated static discharging edges lying on opposite sides of said first width, so as to make the static elimination device reversible.

* * * * *